United States Patent [19]

Dudley et al.

[11] 4,412,117

[45] Oct. 25, 1983

[54] MICROWAVE OVEN FEED SYSTEM

[75] Inventors: Kenneth W. Dudley, Sudbury; Wesley W. Teich, Wayland; Robert F. Bowen, Burlington, all of Mass.

[73] Assignee: Raytheon Company, Lexington, Mass.

[21] Appl. No.: 301,055

[22] Filed: Sep. 10, 1981

Related U.S. Application Data

[62] Division of Ser. No. 146,561, May 5, 1980, Pat. No. 4,350,859.

[51] Int. Cl.[3] ..... H05B 6/72; H05B 6/76

[52] U.S. Cl. ..... 219/10.55 F; 219/10.55 D

[58] Field of Search ..... 219/10.55 F, 10.55 B, 219/10.55 D, 10.55 R, 10.55 M

[56] References Cited

U.S. PATENT DOCUMENTS

| | | | |
|---|---|---|---|
| 2,772,402 | 11/1956 | Tomiyasu | 333/254 X |
| 4,105,886 | 8/1978 | Baron et al. | 219/10.55 F |
| 4,165,454 | 8/1979 | Carlsson et al. | 219/10.55 F |
| 4,316,069 | 2/1982 | Fitzmayer | 219/10.55 F |
| 4,335,290 | 6/1982 | Teich | 219/10.55 R X |

*Primary Examiner*—B. A. Reynolds
*Assistant Examiner*—Philip H. Leung
*Attorney, Agent, or Firm*—William R. Clark; Joseph D. Pannone

[57] ABSTRACT

A microwave oven feed system having the output probe of the magnetron inserted directly into the microwave enclosure. A rotating feed structure positioned within the enclosure couples the microwave energy from the probe into a directive radiation pattern towards the food. The feed structure may be located in a well extending from the enclosure and separated from the processing cavity by a layer of microwave transparent material, the functions of the layer being to provide thermal isolation and to provide a protective covering for the feed structure. A microwave choke around the periphery of the well prevents leakage of microwave energy from the enclosure. The choke may be elevated from the floor of the cavity to prevent food drippings and spilled soups from running into the feed structure well.

8 Claims, 3 Drawing Figures

FIG. 3
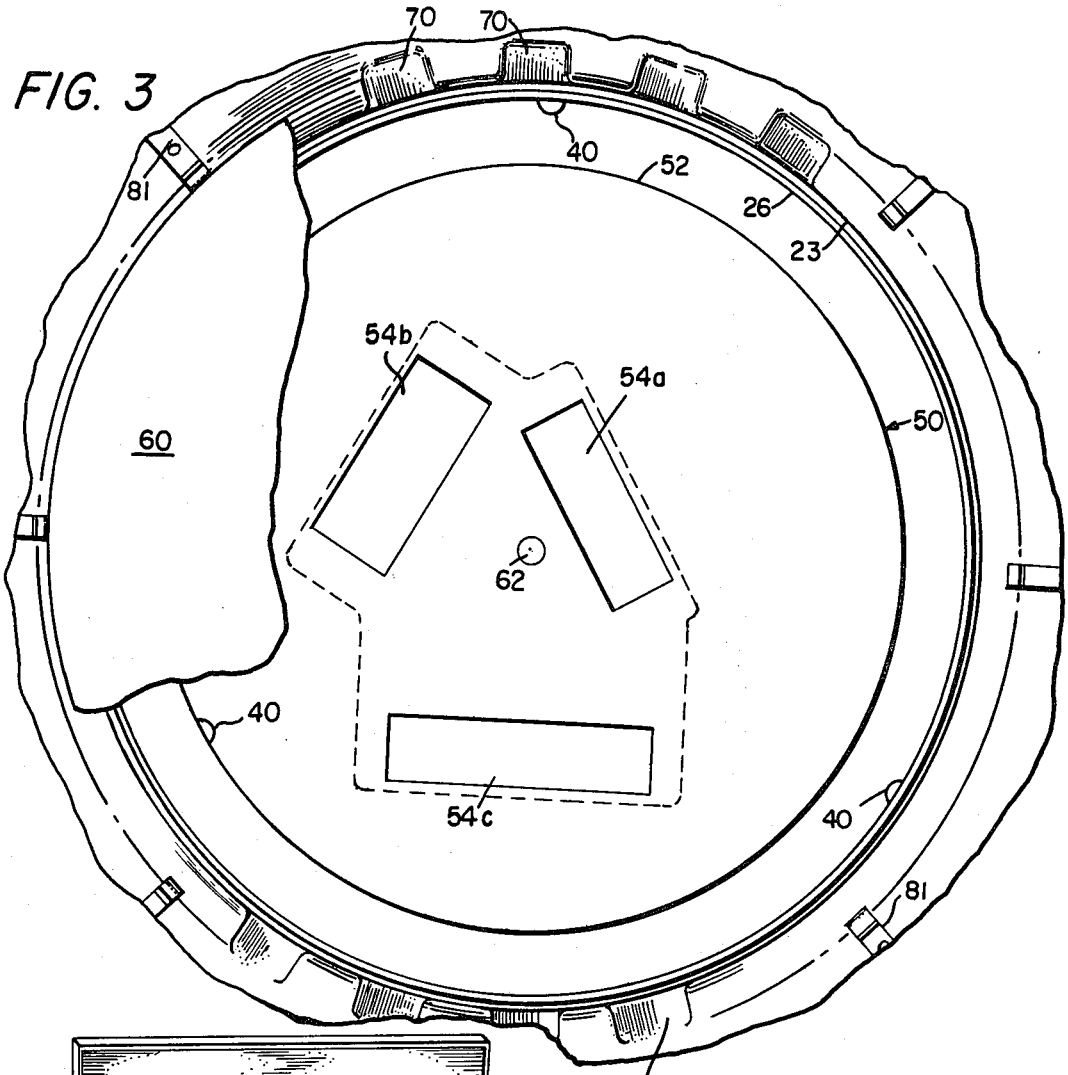
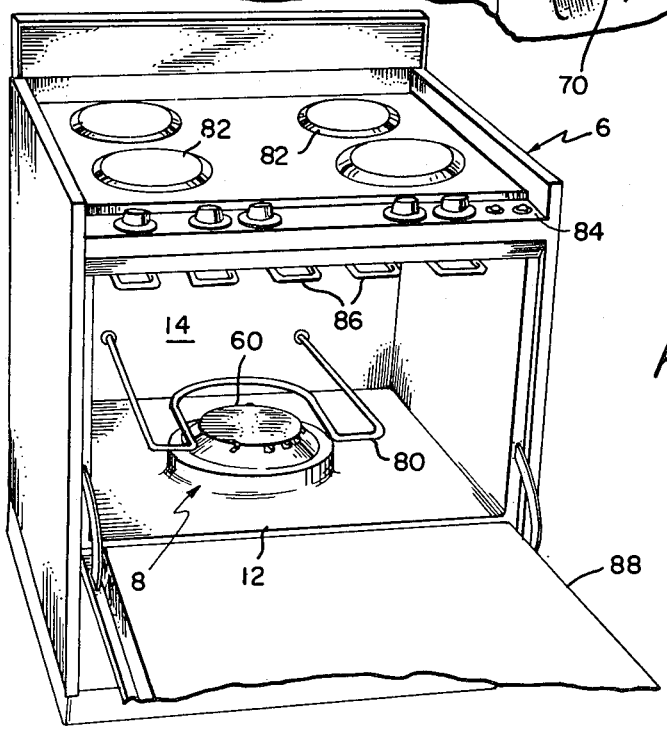
FIG. 1

MICROWAVE OVEN FEED SYSTEM

CROSS-REFERENCE TO RELATED APPLICATIONS

This is a division of application Ser. No. 146,561, filed May 5, 1980, now U.S. Pat. No. 4,350,859.

BACKGROUND OF THE INVENTION

Two design objectives of a microwave oven are (1) that the energy distribution within the cavity be such as to provide uniform heating in food and (2) that there be an acceptable load impedance on the magnetron with any of a variety of food loads in the cavity. With regard to the second objective, an acceptable load impedance is one which will provide sufficient loading for the magnetron to prevent excessive anode heating without loading the magnetron so heavily that it will fail to oscillate at the correct frequency and shift to another mode. In other words, the magnetron should be coupled tightly enough so as to get good efficiency or maximum power output but loosely enough to give good frequency stability. The magnetron performance effects of impedance matches are well knwon and generally specified by magnetron manufacturers on Reike Diagrams.

When microwave ovens were first introduced for food cooking and industrial processing, some models had the output probe of the magnetron inserted directly into the microwave enclosure. It was found that some improvement could be gained in heating uniformity by positioning a moving device commonly referred to as a mode stirrer in the enclosure. However, with the direct insertion configuration, little was done to provide the magnetron with an acceptable impedance load with a variety of food loads. Accordingly, it was common to have the magnetron operating inefficiently and/or with poor frequency stability.

One way of providing an acceptable impedance match for the magnetron is to couple it into a waveguide; this has become the conventional microwave feed system. Typically, the output probe of the magnetron is inserted into a waveguide approximately one-quarter wavelength from a shorted end so that substantially all the microwave energy couples in the opposite direction. Generally, the end opposite the shorted end opens into the microwave enclosure. A mode stirrer means is commonly positioned in the waveguide or adjacent to it within the microwave enclosure. Coupling the magnetron output probe into a waveguide and the waveguide into the cavity provided for smaller impedance variations on the magnetron as a result of different food loads.

The use of a waveguide external to the microwave cavity has several significant disadvantages. First, there is the cost of the waveguide that obviously must be included in the price of the oven. Second, there are microwave energy losses in the waveguide which reduce the efficiency of the system. Third, the coupling of microwave energy into the cavity from a waveguide to set up standing waves which are varied by a mode stirrer has not produced the most desirable uniformity in cooking.

The elimination of the external waveguide creates many significant problems. For example, an acceptable impedance match must be provided for the magnetron for a variety of food loads. Also, uniformity of heating within the foods must be provided. Furthermore, if the microwave feed system is used in a combination oven which has an additional heat source for self-cleaning by pyrolysis, a means for isolating the magnetron from the self-cleaning temperatures must be provided. Also, there must be a method for sealing the feed system to prevent leakage of microwave energy.

SUMMARY OF THE INVENTION

It is an object of the invention to provide a microwave feed system which eliminates the waveguide external to the cavity. Furthermore, it is an object to provide a feed system that provides heating uniformity within the food and at the same time provides an optimum matched load for the magnetron with a variety of food loads. More specifically, it is preferable that the optimum combination of power, efficiency and frequency stability be provided by properly matching the impedance of the magnetron for a variety of food loads.

It is also an object of the invention to provide a mircowave feed system that may be used in a combination microwave oven where cavity temperatures may be above 900° F. in the self clean mode. Specifically, the feed system must isolate the magnetron from the self-cleaning temperatures.

Also, it may be an objective of the invention to provide a choking structure to prevent microwave energy from leaking between the feed well and the floor of the microwave cavity. It is also an objective that the feed structure prevent food drippings or spilled soup from getting into the feed well.

These and other objects and advantages will become apparent from the reading of the attached detailed description with reference to the drawings. The invention discloses an enclosure for exposing bodies to microwave energy comprising a plurality of metallic surfaces one of which has an aperture, a magnetron mounted external to the enclosure and having its output probe inserted through the aperture into the enclosure, means positioned adjacent to the output probe within the enclosure for coupling microwave energy from the output probe into a directive radiation pattern and means for rotating the coupling means about an axis passing through the probe. It may be preferable that the coupling means comprises a flat plate having a plurality of slots therein for transferring microwave energy from the output probe through the slots. Substantially all of the microwave energy introduced into the enclosure may be radiated from the slots or a similar plurality of antennas. The enclosure may be defined as a rectangular cross-section box having a cylinder extending from a circular orifice in one of the surfaces of the box. Furthermore, the means for rotating the coupling means may comprise air driven means.

The invention may also be practiced by the combination of a microwave oven cavity having an orifice in one of the surfaces of the cavity, a metallic cylinder attached to one of said surfaces extending outward from the orifice to a bottom having an aperture therein, a magnetron mounted external to the interior defined by the cylinder and the bottom with the magnetron having its output probe inserted through the aperture into the cylinder, and means for coupling microwave energy from the probe into a directive radiation pattern directed through the cylinder into the cavity. It may be preferable to provide means for rotating the coupling means. Also, a heating element may be positioned within the cavity.

Furthermore, the invention may be disclosed by the combination of a cavity for exposing bodies to microwave energy comprising a plurality of metallic surfaces with the bottom surface having an orifice, a tunnel extending through the orifice into the cavity, the bottom surface around the tunnel having a raised portion comprising first and second surfaces parallel to the tunnel with at least a portion of the second surface being above the top of the first surface, the distance from the first surface to the tunnel being approximately one quarter wavelength of the energy, the distance from the second surface being less than one quarter inch from the tunnel. It may be preferable that the second surface have a plurality of vertical slots to prevent the transmission of energy in the peripheral direction around the second surface. Also, means for introducing microwave energy into the tunnel directed towards the cavity is provided.

BRIEF DESCRIPTION OF THE DRAWINGS

The foregoing will be better understood from a reading of the description of the preferred embodiment with reference to the drawings wherein:

FIG. 1 is a view of a combination microwave electric range;

FIG. 3 is a partially cut away view of the feed system of FIG. 2 viewed from the top.

DESCRIPTION OF THE PREFERRED EMBODIMENT

Figure 2:
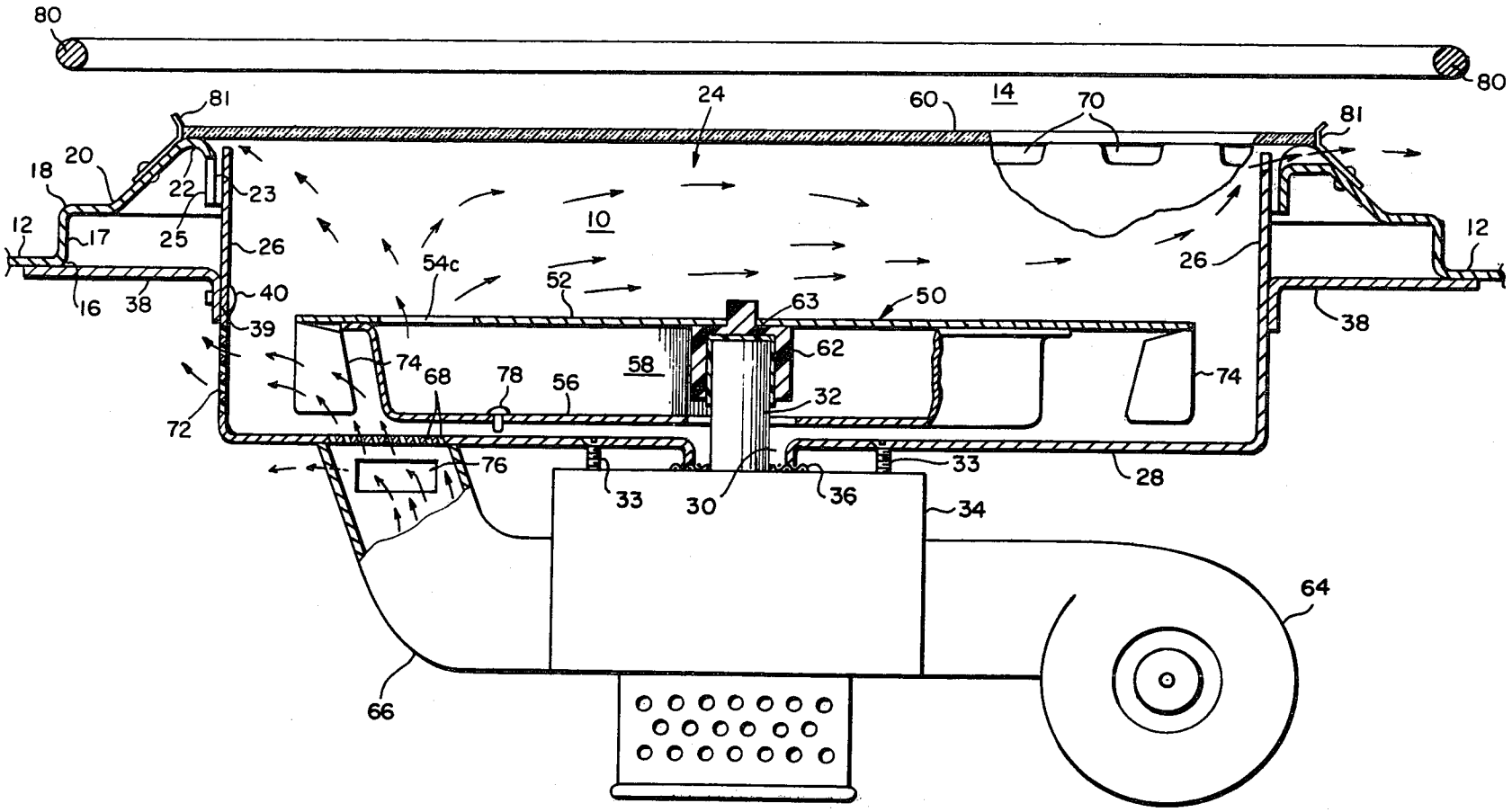
FIG. 2 is a partially cut away side elevation of the microwave feed system shown on the floor of the range of FIG. 1.

Referring to FIG. 1, there is shown a free standing combination microwave/electric range 6 which embodies the invention to advantage. The invention may also be embodied in a combination mircowave/gas range or just a plain microwave oven. The range has conventional surface heating elements 82 and a control panel 84 for operating both the surface heating elements and the oven. Additional knobs would generally be provided for selecting the individual operation of microwave and electric heating with various power settings, cooking modes, and time controls. The oven has a heating element 80 positioned at the bottom of the cavity to provide heat for normal bake and self-cleaning. As is well known, self-cleaning by pyrolysis typically requires temperatures in the range from 880° F. to 1100° F. A second heating element 86 is spaced a short distance from the top of the oven and provides broiling.

The source of microwave energy is microwave feed system 8 which embodies the invention. It is described in detail with reference to FIGS. 2 and 3. Range 6 includes many features such as, for example, door 88 which prevents the leakage of mircowave energy, thermal insulation (not shown) in the walls, and a top vent for exhausting self-cleaning gases. These as well as other features are conventional and are, therefore, not described in detail herein.

Referring to FIG. 2, there is shown a partially cut away elevation view of microwave feed system 8 including a mircowave feed well 10 which is attached to the floor 12 of the microwave cavity 14. Along a circle with a radius of approximately 6.5 inches from a center in the middle of floor 12, the floor is shaped upwards at a right angle 16 for approximately 0.5 inches along surface 17 to another right angle bend 18 towards the center for 0.5 inches to an upward 45° bend 20 for approximately one inch to a rounded 135° bend 22 back down towards the floor for almost one inch along surface 23. The floor is fabricated of porcelain enameled steel and the bends so described forming a mound around circular hole 24 are manufactured by stamping. Circular hole 24 is approximately 10 inches in diameter.

In circular hole 24 is attached microwave feed well 10 which comprises a cylinder 26 with bottom disk 28 having a circular hole 30 in the center for insertion of output probe 32 of magnetron 34 which is connected to disk 28 by bolts 33. The inner edge of disk 28 is formed downward as shown in FIG. 2 to make contact with wire mesh gasket 36 of the magnetron thereby preventing leakage of microwave energy from well 10 toward the magnetron. Well 10 is secured to the floor of the oven by bracket 38 which is a circular plate that preferably is welded along its outer circumference to the bottom of floor 12. An approximately 10 inch concentric circular aperture is cut from bracket 38 and the inner edge is bent downward at a right angle as shown to provide a surface 39 through which rivets 40 connect well 10 to bracket 38. For a reason to be described later herein, only three rivets 40 are used around the circumference of cylinder 26 of well 10 to connect the same to bracket 38.

Feed structure 50 couples the microwave energy from the magnetron output probe 32 into a directive radiation pattern that is not coaxial with the axis of rotation that will be described later herein. The feed structure first comprises flat plate 52 that has a circular planar surface approximately nine inches in diameter. A first slot **54*a* which is the closest to the geometric center has dimensions $3\times1$ inches with the length being perpendicular and centered on a first radii of the plate. The near side of the slot is approximately 0.69 inches from the center. A second slot 54*b* which is next closest to the geometric center has dimensions of $3\times1.31$ inches with the length being perpendicular and centered on a second radii of the plate. A third slot 54*c*** which is farthest from the geometric center has dimensions of $4\times0.95$ inches with the length being perpendicular and centered on a third radii of the plate. The first, second and third radii are spaced 120° apart.

Feed structure 50 further comprises dish 56 which is connected to flat plate 52 by means such as a plurality of rivets or spot welds. Dish 56 is shaped so as to substantially form three separate waveguides from the axis of rotation at the output probe of the magnetron to the individual slots which function as antennas. The width of each waveguide is approximately four inches and each side runs inward until it intersects a side from the adjacent waveguide. The general form of the dish is shown by the dotted line in FIG. 3. Microwave energy is introduced into the feed structure cavity 58 formed by flat plate 52 and dish 56 by the magnetron output probe at the center junction or common excitation point. The energy travels outward through the three waveguides to the respective slots. At the slots, the energy couples into the well with the E field substantially altered by approximately 90° during the transition from waveguide to free space. The microwave energy passes through cover 60 which is substantially transparent to microwave energy. It may be preferable that cover 60 be fabricated from Pyroceram material because it provides good thermal insulation. Feed structure 50 substantially provides a directional antenna and the pattern may be described according to conventional near field power pattern theory. In a heavily loaded oven, the energy distribution from the feed structure directly into the food can be likened to a system having no oven walls; this is substantially different than conventional coupling of microwave energy into the cavity through a waveguide with a mode stirrer positioned somewhere in the cavity to alter the modes as set up between the walls of the cavity.

It has been found that very desirable heating characteristics are created by a feed structure which is rotated and which in a stationary position provides a directive radiation pattern which is not coaxial with the axis of rotation. The specific feed structure 50 described in detail earlier herein provides these desirable heating characteristics. It will be understood by those skilled in the art, however, that the particular details of the feed structure may be modified without departing from the inventive concept. For example, although three slots 54*a–c* are shown, it may be preferable to provide a different number. It may also be preferable that the slots be positioned at different distances from the geometric center of the plate than shown and have different dimensions than described. It has been discovered that the radiation pattern becomes more directive when the number of slots is increased. Also, positioning the slots further from the geometric center of the flat plate generally contributes to making the pattern more directive. Although directivity in general is a desirable characteristic, there obviously is a limit to the amount of directivity that is desirable. Further, there are mechanical limitations as to the numer of slots that can be provided. Also, the size of the flat plate limits the distance from the center at which the slots can be located. Generally speaking, the slots should be on the order of one quarter wavelength or less wide and greater than one half wavelength long. It is apparent that the amount of energy radiated from a particular slot is in part a function of the size of the slot and its position on the plate relative to the output probe. Furthermore, a plurality of antennas other than slot antennas could be used.

As shown in FIG. 2, microwave energy is coupled to the three waveguides from a common excitation point by inserting the magnetron output probe 32 directly into the feed structure. As mentioned earlier herein, it is advantageous that the feed system provide a distribution of power within the cavity which affects uniform cooking. With the feed structure shown in FIGS. 2 and 3, a very desirable pattern is radiated which, when rotated, provides uniform cooking. However, it is also advantageous that the feed system for coupling the output of the magnetron into the oven cavity provides an acceptable load impedance to the magnetron with any of a variety of food loads in the oven. As is known to those skilled in the art, this acceptable load impedance is one which provides sufficient loading for the magnetron to prevent excessive anode heating and yet does not load the magnetron so heavily that it will fail to oscillate at the specified frequency and shift to another mode. In other words, the magnetron must be coupled tightly enough to get good efficiency or maximum power output but loosely enough to give good frequency stability. The magnetron performance effects of impedance matches are well known and are generally specified by magnetron manufacturers on Reike Diagrams.

In addition to providing support for feed structure 50 resting on output probe 32, bearing 62 also serves as a dielectric material for providing a desirable impedance match for the magnetron to the waveguide transitions. More specifically, bearing 62 provides capacitive loading between the output probe and flat plate 52 which is induced towards the instantaneous voltage potential of the output probe. The most preferable dimensions of bearing 62 depend on the material used, the particular magnetron model, and the feed structure. For example, in the preferred embodiment, bearing 62 comprises Teflon or a similar synthetic resin polymer which has the additional advantages of being transparent to microwave energy and having a favorable coefficient of friction with the cap 63 of the output probe. The magnetron used in a demonstration model was a Hitachi Model 2M170 and the feed structure dimensions were as described earlier herein. For this example configuration, it was found that optimum coupling results were obtained using a bearing 62 having a one sixteenth to one eighth inch layer between flat plate 52 and the cap 63 of output probe 32. The outside diameter of the bearing cylinder encasing output probe 32 is 0.665 inches. Furthermore, it is preferable that the cylinder extend down over the output probe for at least one half inch to minimize feed structure 50 wobbling while rotating in a horizontal plane. Bearing 62 is attached to flat plate 52 by pressing a circular projection of the soft Teflon through a slightly smaller circular hole in the center of the plate. The inside of the cylinder of the bearing fits snugly enough over the cap 63 of the output probe to provide support to prevent feed structure 50 from tilting from the horizontal plane; however, it is loose enough so as to minimize friction which would inhibit the rotation of the bearing over the cap.

Blower 64 directs a stream of air across the fins (not shown) of the magnetron for cooling. The air is then channeled by duct 66 up to the bottom disk 28 of the well where it passes through angled perforation 68 as shown into the well. Perforations 68 are small enough in diameter so as to prevent microwave energy from propagating from the interior of the well out. The air pressure created in the well interior by the introduction of air through perforations 68 causes air to be vented from the well in either or both of two preferable locations. First, because it is advantageous to circulate air through a microwave cavity while cooking to remove water vapor among other effluents, it may be preferable to direct air into mircowave cavity 14. Gaps 70 are provided between the upper support surface of 135° bend 22 and cover 60. Also, air passage space between the two surfaces may be provided by such means as bumps along the ridge of bend 22 or horizontal grooves in cover 60. It is advantageous not to have any vertical air passages from cavity 14 into well 10; drippings from cooking foods or spilled soup could pass through vertical passages and become deposited within well 10 causing undesirable effects. Second, air may be vented from well 10 through perforations 72 in cylinder 26. The function of perforations 72 may be to create an air flow path from perforations 68 which passes across blades 74 to accomplish air driven rotation of feed structure 50. Even if perforation 68 had not been angled and perforations 72 were not provided in cylinder 26, air driven rotation could still be created by the slight build up of air pressure underneath flat plate 52 and the outward movement across blades 74 which are angularly positioned from radial lines. Perforations 72 may also serve to decrease the pressure inside well 10 and thereby controllably reduce the amount of air flowing into cavity 14 through gaps 70. Vent 76 may be cut into duct 66 to reduce the amount of air passing across blades 74 without reducing the required amount of air passing across the magnetron fins for cooling.

As described earlier herein, flat plate 52 has a diameter of 9 inches. Although this dimension is not critical in the design, the flat surface was formed from an 11 inch diameter disk. A plurality of one inch slits were cut inward from the circumference of the disk along radial lines. Also, small notches were angularly cut from the inward ends of the slits so that the surface areas between the slits could be folded down and twisted at an angle to form blades 74. Teflon rivet 78 may be engaged to dish 56 so as to eliminate the possibility of feed structure 50 making contact with bottom disk 28 of well 10 caused by wobbling during rotation of the feed structure. Arcing is not considered to be a serious problem anyway because the voltage potential difference between dish 56 near disk 28 is very small. Furthermore, other steps were taken to insure that feed structure 50 remains in a horizontal plane during rotation. As described earlier herein, the cylinder of bearing 62 preferably extends downward over cap 63 for at least one half inch to provide stability. Also, weights (not shown) may be attached to feed structure 50 to compensate for the unbalance caused by the nonsymmetric dish.

The combination of the cavity floor 12 portion formed by bends 16, 18, 20 and 22, the upper portion of cylinder 26 of well 10 and bracket 38 form a microwave choke which prevents microwave leakage from the region between the cavity floor and the well. Specifically, the distance between cylinder 26 and surface 17 is one quarter wavelength of the microwave energy. According to well known guide stub theory, energy attempting to propagate between cylinder 26 and surface 23 of the cavity floor 12 sees the reflection from surface 17 and the resulting high impedance. Thin vertical, rectangular sections 25 are cut around the periphery of surface 23 to form gaps which substantially prevent the propagation of energy in a peripheral mode around surface 23. The general technique and theory of this type choke is taught in U.S. Pat. No. 3,767,884 to Osepchuk, assigned to the same assignee herein, which patent is hereby incorporated by reference. It is preferable that the spacing between surface 23 and cylinder 26 is one eighth of an inch ± one sixteenth of an inch. Further, it is preferable that surface 23 be parallel in a vertical direction to cylinder 26 for a distance of at least one half inch.

The raised choke structure formed by bends 16, 18, 20, and 22 also prevents food drippings and spilled soups from running along the cavity floor down into the well to create cleaning problems. In an alternate embodiment of the choke structure, however, the floor 12 of cavity 14 is not raised. Rather, the upper edge of cylinder 26 is bent outward, positioned down against the floor 12 of the cavity and then riveted or spot welded around the periphery at a spacing of not greater than 1.5 inches to create the seal.

As described earlier herein, the microwave feed well 10 may be used to advantage in a combination microwave oven wherein a second heat source such as conventional electric or gas is used. For example, electric heating element 80 provides normal bake and self-cleaning heat for the oven. For self-cleaning pyrolysis, cavity temperatures conventionally must rise to the range from 880° to 1100° F. As typical magnetrons in use today may be damaged if heated above 500° F., a means of thermally isolating the magnetron from the high temperatures in the cavity is required. First, the porcelain enamel walls exhibit some thermal insulation. Second, as mentioned earlier herein, only three rivets 40 were used around the circumference of cylinder 26 of well 10 to attach it to bracket 38. These poor thermal joints substantially reduce the conduction of heat from floor 12 to well 10 through bracket 38. Third, Pyroceram cover 60 which provides protective covering for wall 10 also serves as a good heat insulator. The cover is held in place by clips 81. It was also found that the air space between cover 60 and flat plate 52 provided some thermal insulation and that making the well deeper provided more thermal insulation. However, it was observed that making the distance between cover 60 and flat plate 52 more than three inches adversely affected the power distribution within the cavity. It may be preferable to position a layer of insulation between cover 60 and flat plate 52. Furthermore, in a self-cleaning mode, it is desirable to have a flow of air through the cavity by chimney effect to remove the gaseous by-products of pyrolysis. During this operation, even without the blower being turned on, there is a natural flow of air up through well 10 into cavity 14 to provide further thermal isolation of the well bottom and magnetron.

This completes the description of the preferred embodiment. However, it is understood, that those of ordinary skill in the art will see many modifications and alterations without departing from the spirit and scope of the invention. Therefore, it is intended that the scope of the invention be limited only by the appended claims.

What is claimed is:

1. A self-clean combination microwave conventional heat oven comprising:

a conductive enclosure for exposing bodies to microwave energy comprising a plurality of metallic surfaces, the bottom surface having an orifice;

a tunnel extending through said orifice into said enclosure;

said bottom surface around said tunnel having a raised portion comprising first and second surfaces parallel to said tunnel, at least a portion of said second surface being above the top of said first surface;

the distance from said first surface to said tunnel being approximately one quarter wavelength of said energy from said tunnel;

the distance of said second surface being less than one quarter inch from said tunnel;

a primary radiator of microwave energy positioned in said tunnel;

means for heating said enclosure;

means for coupling microwave energy to said primary radiator;

a metal bracket for attaching said surface to said tunnel, said bracket and said tunnel having a connection having poor thermal conductivity;

said tunnel having cross-sectional orthogonal dimensions greater than a free space wavelength of said energy; and a microwave transparent layer substantially separating the interior of said tunnel from the interior of said enclosure, said layer providing thermal insulation to suppress the temperature in said tunnel from reaching self-cleaning temperatures created by said heating means.

2. The oven in accordance with claim 1 wherein said second surface has a plurality of vertical slots to prevent the propagation of energy around the periphery of said second surface.

3. A self-clean combination conventional heat oven comprising:

a microwave oven enclosure comprising a substantially rectangular conductive box having an aperture in a wall thereof and a conductive well extending outwardly from said aperture, said well having a connection to said wall, said connection providing poor thermal conduction between said wall and said well;

a microwave choke between said connection and said aperture for preventing leakage of microwave energy at said connection, said choke having a quarter wavelength transmission path terminated in an effective short circuit;

means for heating the interior of said box;

a primary microwave energy radiator positioned in said well;

means for coupling microwave energy to said radiator;

said well having cross-sectional orthogonal dimensions greater than a free space wavelength of said microwave energy;

means for rotating said radiator; and a microwave transparent plate positioned over said well substantially separating said box from said well, said plate providing significant thermal insulation between said box and said well for protecting said radiator from self-cleaning temperatures in said box.

4. The oven recited in claim 3 wherein said well is substantially cylindrical.

5. The oven recited on claim 3 wherein said well extends downwardly and has a bottom with a hole therein, the output probe of a magnetron being inserted into the interior of said well, said means for coupling microwave energy to said radiator comprising said magnetron.

6. A self-clean combination microwave conventional heat oven comprising:

a microwave oven enclosure defined by a substantially rectangular conductive box having an aperture in a wall thereof and a conductive circular well extending outwardly from said aperture, said well having a connection to said wall, said connection providing poor thermal conduction between said wall and said well;

a microwave choke between said connection and said aperture for preventing leakage of microwave energy at said connection, said choke having a quarter wavelength transmission path terminated in an effective short circuit;

means for heating the interior of said box;

a primary radiator of microwave energy positioned in said well;

a magnetron positioned external to said well;

the output probe of said magnetron being inserted into said well through a hole in the bottom of said well for coupling microwave energy to said primary radiator;

said well having cross-sectional orthogonal dimensions greater than a free space wavelength of said microwave energy;

means for rotating said radiator; and a microwave transparent layer positioned over said well substantially separating said box from said well, said layer providing thermal insulation between said box and said well for shielding said radiator from self-cleaning temperatures created in said box by said heating means.

7. The oven recited in claim 6 wherein said well is cylindrical.

8. The oven recited in claim 6 wherein said wall defines the floor of said box.

* * * * *